US012692662B2

(12) United States Patent
Tomlinson et al.

(10) Patent No.: US 12,692,662 B2
(45) Date of Patent: Jul. 28, 2026

(54) WATER RESISTANT AND REPULPABLE COMPOSITIONS

(71) Applicant: NEENAH, INC., Alpharetta, GA (US)

(72) Inventors: Norm Tomlinson, Alpharetta, GA (US); Nika Wanserski, Alpharetta, GA (US); Kristen Duncan, Alpharetta, GA (US); Michelle Turner, Alpharetta, GA (US); Doug Grever, Alpharetta, GA (US); Chris Forer, Alpharetta, GA (US)

(73) Assignee: Neenah, Inc., Alpharetta, GA (US)

( * ) Notice: Subject to any disclaimer, the term of this patent is extended or adjusted under 35 U.S.C. 154(b) by 223 days.

(21) Appl. No.: 18/281,270

(22) PCT Filed: Mar. 9, 2022

(86) PCT No.: PCT/US2022/019532

§ 371 (c)(1),
(2) Date: Sep. 8, 2023

(87) PCT Pub. No.: WO2022/192387

PCT Pub. Date: Sep. 15, 2022

(65) Prior Publication Data

US 2024/0175215 A1 May 30, 2024

Related U.S. Application Data

(60) Provisional application No. 63/159,287, filed on Mar. 10, 2021.

(51) Int. Cl.

| | |
|---|---|
| ***D21H 27/10*** | (2006.01) |
| ***B65D 65/42*** | (2006.01) |
| ***D21H 11/14*** | (2006.01) |
| ***D21H 17/29*** | (2006.01) |
| ***D21H 17/37*** | (2006.01) |
| ***D21H 19/12*** | (2006.01) |
| ***D21H 19/20*** | (2006.01) |
| ***D21H 19/40*** | (2006.01) |
| ***D21H 19/84*** | (2006.01) |
| ***D21H 21/16*** | (2006.01) |
| ***D21H 21/18*** | (2006.01) |
| ***D21H 25/06*** | (2006.01) |

(52) U.S. Cl.
CPC ..... *D21H 27/10* (2013.01); *B65D 65/42* (2013.01); *D21H 11/14* (2013.01); *D21H 17/29* (2013.01); *D21H 17/375* (2013.01); *D21H 19/12* (2013.01); *D21H 19/20* (2013.01); *D21H 19/40* (2013.01); *D21H 19/84* (2013.01); *D21H 21/16* (2013.01); *D21H 21/18* (2013.01); *D21H 25/06* (2013.01)

(58) Field of Classification Search
CPC ..... D21H 27/10; D21H 11/14; D21H 17/29; D21H 17/375; D21H 19/12; D21H 19/20; D21H 19/40; D21H 19/84; D21H 21/16; D21H 21/18; D21H 25/06; D21H 19/18; D21H 19/28; D21H 17/28; D21H 19/82; D21H 21/06; B65D 65/42
See application file for complete search history.

(56) References Cited

U.S. PATENT DOCUMENTS

| | | | | |
|---|---|---|---|---|
| 2003/0220036 | A1 | 11/2003 | Lee et al. | |
| 2011/0046284 | A1 | 2/2011 | Berube et al. | |
| 2012/0247696 | A1* | 10/2012 | Bogren | D21C 3/006 162/1 |
| 2015/0048151 | A1* | 2/2015 | Brandow | B65D 5/20 493/128 |
| 2015/0111011 | A1 | 4/2015 | Hoekstra et al. | |
| 2019/0291134 | A1 | 9/2019 | Mongrain | |
| 2020/0263359 | A1 | 8/2020 | Zha et al. | |

FOREIGN PATENT DOCUMENTS

| | | | |
|---|---|---|---|
| CN | 109804118 | A | 5/2019 |
| CN | 111670281 | A | 9/2020 |
| EP | 2682523 | A1 | 1/2014 |
| JP | 2009520117 | A | 5/2009 |
| JP | 2011038187 | A | 2/2011 |
| JP | 2014515714 | A | 7/2014 |
| JP | 2018524199 | A | 8/2018 |
| JP | 2019504215 | A | 2/2019 |
| WO | 9853141 | A1 | 11/1998 |

(Continued)

OTHER PUBLICATIONS

Notification of material filed by a third party, received in connection with Australian Application No. 2022232915, dated Feb. 3, 2025. 6 pages.
First Office Action for Chinese Application No. 202280028112.0, dated May 19, 2025, 10 pages.
International Search Report and Written Opinion received in PCT/US2022/019532, mailed Jun. 29, 2022, 16 pages.
Office Action for Japanese Application No. 2023-555463, dated Dec. 16, 2025, 5 Pages.
Second Office Action for Chinese Application No. 202280028112.0, dated Dec. 2, 2025, 16 Pages.

*Primary Examiner* — Michael C Miggins
(74) *Attorney, Agent, or Firm* — Meunier Carlin & Curfman LLC

(57) ABSTRACT

Disclosed herein is a printable paper comprising a cellulose-based substrate having a first surface and a second surface opposite the first surface, wherein the printable paper has a 2-minute Cobb sizing value of less than 20 g/m$^2$, and wherein the first surface, the second surface, or both has a surface energy of greater than 37 dynes/cm. Further disclosed herein are shipping mailers, such as those derived from the printable papers, and recyclable flexible packaging containers, such as those comprising the printable papers. A method of making a recyclable flexible packaging container is also disclosed herein.

17 Claims, No Drawings

(56) References Cited

FOREIGN PATENT DOCUMENTS

| | | | | | |
|---|---|---|---|---|---|
| WO | 2014108596 | A1 | | 7/2014 | |
| WO | WO2016/072888 | | * | 5/2016 | ..... D21H 19/10 |
| WO | WO-2016072888 | A1 | * | 5/2016 | ..... D21H 27/32 |
| WO | 2020056124 | A1 | | 3/2020 | |

* cited by examiner

WATER RESISTANT AND REPULPABLE COMPOSITIONS

CROSS-REFERENCE TO RELATED APPLICATIONS

This application claims the benefit of and priority to U.S. Patent Application No. 63/159,287 filed on Mar. 10, 2021, the disclosure of which is expressly incorporated herein by reference in its entirety.

FIELD OF THE DISCLOSURE

The present disclosure relates to compositions for packaging, more specifically to water resistant and repulpable shipping packages and paper, and methods of making and using the same.

BACKGROUND

Packaging materials for product retail and shipping purposes are typically sufficiently durable to allow reliable use of the materials. Typical considerations in the development of such materials include their barrier performance, tensile and tear strength, resistance to wrinkling and scuffing, efficiency in manufacturing, as well as resistance to handling, infiltration by rodents and pests, and the ability of the materials and packaging made therefrom to deter theft. The packages and packaging materials are also desirably relatively inexpensive to manufacture, and are preferably attractive to the customer in appearance, print quality, feel, and touch to encourage use of the products as well as to enhance the product image or association.

Although plastic and Tyvek substrates offer advantages over fiber-based materials in terms of durability and water repellency, these materials are over-designed for many E-commerce shipping applications. More importantly, they are becoming increasingly unpopular with many brands from an environmental standpoint. Some groups have favored the use of paper and paperboard, or other products made from wood pulp. In the manufacture of paper and paperboard, or other products made from wood pulp, petroleum derived paraffin waxes and synthetic polymers have been used for many years as moisture retardants, water repellents, oil repellents, stiffeners, strengtheners, and release agents. Besides paraffin, the material used most often is polyethylene, but other widely used polymers include polymerized acrylics, vinyls, styrenes, ethylenes and copolymers or heteropolymers of these monomers. The paper and paperboard to which these traditional materials are applied becomes difficult and often impossible to repulp and recycle in standard paper mill processes because the petroleum derived polymers and, particularly, the petroleum waxes are non-biodegradable in mill white waters (circulated process waters) and discharge effluents. Additionally, the residue of the petroleum waxes that is not removed from pulp fibers during the repulping and recycling processes cause severe problems due to buildup that occurs on the screens and felts used during the process of forming and making the paper or paperboard sheet. In addition, paper and paperboard coated or impregnated with petroleum waxes resist biodegradation and composting when disposed of in landfills and other waste disposal systems. Paper and paperboard coated or impregnated with traditional synthetic polymers and heteropolymers are also difficult and often impossible to repulp and recycle owing to their resistance to separation from the fiber in the standard repulping processes resulting in significant fiber losses in efforts to repulp and recycle them, and these are also non-biodegradable and therefore resist composting.

Furthermore, conventional paper and paperboards used in commerce shipping applications are typically bulky and increase packaging costs.

Accordingly, there is a need to provide replacement of plastic and nonrecyclable shipping packages with recyclable, durable shipping packages used, for example, for apparel and non-fragile goods. The compositions and methods disclosed herein address these and other needs.

SUMMARY OF THE DISCLOSURE

The present disclosure relates generally to printable paper for use as packaging containers, more specifically as commercial mailers. Commercial mailers are used, for instance, for shipping apparel and non-fragile goods. The present disclosure provides an environmentally sustainable alternative to mailers produced from plastic and other non-recyclable materials while providing attractive aesthetics and a level of durability, water resistance, weight, and overall performance important for commercial applications.

The printable paper comprises a cellulose-based substrate having a first surface and a second surface opposite the first surface, wherein the printable paper has a 2-minute Cobb Sizing value of less than 20 g/m$^2$, and wherein the first surface, the second surface, or both has a surface energy of greater than 37 dynes/cm. In some examples, the printable paper is repulpable in accordance with Fiberboard Association Voluntary Standard for Repulping and Recycling Corrugated Fiberboard Treated to Improve its Performance in the Presence of Water and Water Vapor Aug. 16, 2013: Appendix A: Repulpability. In certain examples, the printable paper exhibits a tensile strength (MD) of at least 45 lb/in or at least 70 lb/in, as determined by TAPPI T 494. The printable paper can have a basis weight of 120 lbs/3000 ft$^2$ or less or from 60 lbs/3000 ft$^2$ to 120 lbs/3000 ft$^2$. In some examples, the printable paper has a 2-minute Cobb Sizing of less than 15 g/m$^2$. In certain examples, the first surface, the second surface, or both has a surface energy of from 40 dynes/cm to 45 dynes/cm. The printable paper can exhibit a tensile energy absorption (MD) of at least 200 J/m$^2$, as determined by TAPPI T 494. In some examples, the printable paper exhibits a tear resistance (MD) of at least 170 gf, as determined by TAPPI T 414. In specific examples, the tensile index (MD) as defined by dividing the tensile strength in N/m by the basis weight in g/m$^2$ is from 70 to 95 Nm/g. The printable paper can be produced with strength properties well suited for commercial mailer applications having a basis weight of 120 lbs/3000 ft$^2$ or less (e.g., from 60 lbs/3000 ft$^2$ to 120 lbs/3000 ft$^2$, from 69 lbs/3000 ft$^2$ to 120 lbs/3000 ft$^2$, or from 60 lbs/3000 ft$^2$ to 100 lbs/3000 ft$^2$).

In specific examples, the cellulose-based substrate (also referred to herein as base sheet or base stock) can be produced with a fiber furnish comprising at least 50% by weight post-consumer waste (PCW, for e.g., PCW having up to 30% by weight bleached softwood and up to 70% by weight bleached hardwood) and at least 40% by weight softwood pulp. The softwood pulp preferably comprises at least 75% black spruce fiber. For example, the cellulose-based substrate can include 50% PCW and 50% Northern Bleached Softwood kraft (NBSK) composed predominately (>75%) of spruce fiber. The use of bleached fibers provides an opportunity to manufacture custom colors for brand differentiation. Overall, the cellulose-based substrate can be derived from at least 60% by weight softwood and 40% by weight or less hardwood.

In certain examples, the cellulose-based substrate includes dry strength additives. In specific examples, the dry strength additives include a cationic starch and a polyacrylamide resin. The cationic starch and polyacrylamide resin can be added at the wet end of the paper machine. Suitable cationic starches include quaternary ammonium based cationic starches, tertiary amino based cationic starches, or a combination thereof. The cationic starch can be present in an amount of at least 1% by weight, or from 1% to 2.5% by weight of the cellulose-based substrate. Suitable polyacrylamide resins can include anionic or cationic based polyacrylamide resins, for example, glyoxalated polyacrylamide resins (Hercobond 1000 available from Solenis), or anionic polyacrylamide-acrylic acid (Hercobond 2000 available from Solenis). The polyacrylamide resin can be present in an amount of at least 0.1% by weight, from 0.1% to 0.5% by weight, or from 0.2% to 0.4% by weight of the cellulose-based substrate.

In some examples, the printable paper further comprises a barrier coating on the first surface of the cellulose-based substrate. The barrier coating can have a coating weight from 2 $g/m^2$ to 20 $g/m^2$, from 2 $g/m^2$ to 15 $g/m^2$ or from 5 $g/m^2$ to 12 $g/m^2$. In certain examples, printable barrier coating is derived from an aqueous-based polymer. In certain examples, the aqueous-based polymer coating comprises an acrylic homopolymer, an acrylic copolymer, a polyester acrylic copolymer, a vinyl acrylic copolymer, a wax emulsion, or a combination thereof. The printable barrier coating can be surface treated with a high energy discharge and, in some examples, the printable barrier coating can be surface treated using corona treatment. Corona treatment can increase the surface energy (dyne level) to a range acceptable for most print and adhesive processes while still maintaining protection from wet environments. Corona treatment may also create cross-links on the barrier surface that reduce the inter-diffusion of polymer chains, thereby changing the failure mode of the material. In some examples, the printable barrier coating further comprises an inorganic particle such as silica. In certain examples, the inorganic particle is surface treated. The barrier coating is provided to protect against wet environments but generally, imparts low surface energy to the coated substrate and thus retards water penetration, impairs printability (including ink absorption and drying), as well as the adhesion of cold liquid glues, hot melt and pressure sensitive adhesives used to produce the mailers.

In some examples, the printable paper further comprises a back coating on the second surface of the cellulose-based surface. In certain embodiments, the back coating comprises a film-forming hydrophilic polymer. Examples of suitable film-forming hydrophilic polymers include polyvinyl alcohol, polyester elastomer, a natural-based polymer (e.g., starch, gum, or cellulose), or a combination thereof. The back coating can be applied at a coating weight from 0.1 $g/m^2$ to 5 $g/m^2$, or from 0.2 $g/m^2$ to 2 $g/m^2$ or have a thickness of from 1 to 75 micrometers or from 1 to 25 micrometers.

Also provided herein, is a shipping mailer derived from a printable paper as described herein. In some examples, the entire shipping mailer is derived from the printable paper. In certain examples, the shipping mailer is an envelope.

Also provided herein, is a recyclable flexible packaging container comprising the printable paper, comprising the cellulose-based substrate, wherein the first surface forms an exterior surface of the container and the second surface forms an interior surface of the container and defines a product volume. In some examples, all of the materials forming the container are recyclable in a single stream. In certain examples, the container is an envelope. Also provided herein, is a method of making a recyclable flexible packaging container comprising the printable paper as described herein, comprising forming an exterior surface of the container comprising the first surface, and forming an interior surface of the container comprising the second surface, wherein the second surface defines a product volume.

The recyclable packaging container provides a light fiber-based mailer option that is moisture resistant and repulpable. More specifically, the present disclosure provides advantages over existing fiber-based packaging containers in terms of weight, water resistance, durability, reusability, aesthetics and the incorporation of post-consumer waste fiber in its construction. The cellulose-based substrate provides for strength and durability. Tensile strength, tensile energy absorption, tear resistance and burst strength have been maximized through the selection of fiber types, refining methodology and the use of cationic starch and polyacrylamide dry strength resin. The internal sizing of the base stock can provide hold-out of surface barrier coatings while allowing backside water penetration to ensure repulpability. For example, to provide protection from rain, snow, and wet environments, the barrier coating is applied to one side of the base stock.

The details of one or more embodiments are set forth in the description below. Other features, objects, and advantages will be apparent from the description and from the claims.

DETAILED DESCRIPTION

The present disclosure relates to, among other things, printable papers for shipping packages. The printable papers comprise a cellulose-based substrate having a first surface and a second surface opposite the first surface. In some embodiments, the printable paper further comprises a barrier coating on the first surface of the cellulose-based substrate. The present disclosure also relates to shipping mailers, such as those derived from the printable papers, and recyclable flexible packaging containers, such as those comprising the printable paper. A method of making a recyclable flexible packaging container is also disclosed herein.

Cellulose Based Substrates

The cellulose-based substrate can comprise any variety of different materials. In some embodiments, for example, the cellulose-based substrate contains a fibrous web formed from a cellulosic fibrous material. As used herein, the term "cellulosic fibrous material" generally refers to a material that contains wood-based pulps or other non-wood derived fiber sources (e.g., at least about 65% by weight, at least about 75% by weight, at least about 85% by weight, at least about 95% by weight, or up to 100% by weight of the total fibers in the web are cellulosic). The pulp may be a primary fibrous material, a secondary fibrous material ("recycled") such as from post-consumer waste, or a combination thereof. Sources of pulp fibers include, by way of example, woods, such as softwoods and hardwoods; straws and grasses, such as rice, esparto, wheat, rye, and sabai; canes and reeds, such as bagasse; bamboos; woody stalks, such as jute, flax, kenaf, and *cannabis*; bast, such as linen and ramie; leaves, such as abaca and sisal; and seeds, such as cotton and cotton liners. Softwoods and hardwoods are the more commonly used sources of cellulose fibers. Examples of softwoods include, by way of illustration only, pine (for example, longleaf pine, shortleaf pine, loblolly pine, slash pine, Southern pine), black spruce, white spruce, jack pine, balsam fir, douglas fir, western hemlock, redwood, red cedar, northern softwood, southern softwood, hemlock, spruce (for example, black spruce), combinations thereof, and the like. Examples of hardwoods include, again by way of illustration only, aspen, birch, beech, oak, maple, *eucalyptus*, and gum. Specific examples of such pulp fibers include softwood pulps available as Northern Bleached Softwood kraft (NBSK) pulps.

Different cellulosic fibers may be selected to provide different attributes. The choice of fiber sources depends in part on the final application of the web. For example, softwood fibers may be included in the web to increase tensile strength. Hardwood fibers may be selected for their ability to improve formation or uniformity in distribution of the fibers. The cellulose-based substrate can be, in certain embodiments, at least about 50% by weight softwood fibers (based on the total dry weight of the cellulosic fibers in the web), such as at least about 60% by weight (i.e., from about 65% by weight to about 95% by weight, from about 75% by weight to about 90% by weight, or from about 75% by weight to about 85% by weight). In one particular embodiment, softwood fibers can form substantially 100% by weight of the total cellulosic fibers in the cellulose-based substrate (i.e., consist essentially of softwood cellulosic fibers) without the presence of any significant amount of hardwood fibers. The cellulose-based substrate can be, in certain embodiments, less than about 50% by weight hardwood fibers (based on the total dry weight of the cellulosic fibers in the web), such as less than about 45% by weight (i.e., from about 15% by weight to about 45% by weight, from about 20% by weight to about 40% by weight, or from about 25% by weight to about 40% by weight).

In certain examples, the cellulose-based substrate can be produced with a fiber furnish comprising at least 50% post-consumer waste (for example containing from about 15% to about 50% by weight bleached softwood fibers and from about 50% to about 85% by weight bleached hardwood fibers) and up to 50% softwood pulp. The softwood pulp preferably comprises at least 75% spruce fiber. For example, the cellulose-based substrate can include 50% post-consumer waste and 50% Northern Bleached Softwood kraft (NBSK) composed predominately (>75%) of spruce fiber. The use of bleached fibers provides an opportunity to manufacture custom colors for brand differentiation.

In some embodiments, the cellulose-based substrate can have a basis weight of 120 lbs/3000 $ft^2$ or less (e.g., 115 lbs/3000 $ft^2$ or less, 110 lbs/3000 $ft^2$ or less, 105 lbs/3000 $ft^2$ or less, 100 lbs/3000 $ft^2$ or less, 95 lbs/3000 $ft^2$ or less, 90 lbs/3000 $ft^2$ or less, 85 lbs/3000 $ft^2$ or less, 80 lbs/3000 $ft^2$ or less, 75 lbs/3000 $ft^2$ or less, 70 lbs/3000 $ft^2$ or less, 65 lbs/3000 $ft^2$ or less, 60 lbs/3000 $ft^2$ or less, 55 lbs/3000 $ft^2$ or less, or 50 lbs/3000 $ft^2$ or less). In some embodiments, the cellulose-based substrate has a basis weight of 45 lbs/3000 $ft^2$ or greater (e.g., 50 lbs/3000 $ft^2$ or greater, 55 lbs/3000 $ft^2$ or greater, 60 lbs/3000 $ft^2$ or greater, 65 lbs/3000 $ft^2$ or greater, 70 lbs/3000 $ft^2$ or greater, 75 lbs/3000 $ft^2$ or greater, 80 lbs/3000 $ft^2$ or greater, 85 lbs/3000 $ft^2$ or greater, 90 lbs/3000 $ft^2$ or greater, 95 lbs/3000 $ft^2$ or greater, 100 lbs/3000 $ft^2$ or greater, 105 lbs/3000 $ft^2$ or greater, 110 lbs/3000 $ft^2$ lbs/3000 $ft^2$ or greater, 115 lbs/3000 $ft^2$ or greater, or 120 lbs/3000 $ft^2$ or greater). In some embodiments, the cellulose-based substrate has a basis weight from 50 lbs/3000 $ft^2$ to 120 lbs/3000 $ft^2$ (e.g., from 60 lbs/3000 $ft^2$ to 120 lbs/3000 $ft^2$, from 70 lbs/3000 $ft^2$ to 110 lbs/3000 $ft^2$, from 70 lbs/3000 $ft^2$ to 100 lbs/3000 $ft^2$, or from 75 lbs/3000 $ft^2$ to 100 lbs/3000 $ft^2$ Strength Additives To improve dry and temporary wet strength, retention and drainage, productivity, reduce basis weight, improve energy efficiency, reduce furnish costs, increase felt life, a strength additive can be included in the cellulose-based substrate. The strength additives can typically provide more or less long-term moisture resistance to a thin paper sheet structure. In some instances, while high strength is desirable in the paper applications, papers having such characteristics are often repulpable only under severe conditions. For example, resins containing azetidinium functionality is generally accompanied by difficulty in recycling or reclaiming the paper by repulping back to individual fibers. Repulping such paper requires treating it under heat and chemical conditions adequate to cause amide hydrolysis while subjecting it to sufficient physical forces to break apart the fiber network. Other strength additives may possess better repulpability, but their strength may not be as high as that obtained with other strength resins.

The strength additives included in the papers described herein can be a cationic, nonionic, anionic or amphoteric, water-soluble resin which is self-retaining on paper and ideally suited for use as a wet and dry strength resin which imparts enhanced dry strength and effectively wet strength to the paper. Dry strength additives include the strength additives discussed herein that enhance the dry strength of the material. Moreover, paper containing the strength additives described herein repulps, in some instances, faster than paper that is essentially the same but contains conventional dry and wet strength resins. Preferably, the strength additives used in the cellulose-based substrates described herein can include anionic or cationic polyacrylamide resins such as those available under the tradename Hercobond®. Specific examples include cationic glyoxylated polyacrylamides and anionic polyacrylamide-acrylic acid resins. Additional examples of strength additives include cationic starches, polyamide-polyamine-epichlorohydrin resins, polyamino-amide-epichlorohydrin resins, polyethylenimine resins and aminoplast resins, modified starches and other polysaccharides such as amphoteric and anionic starches, guar gum and locust bean gum, modified polyacrylamides, carboxymethyl cellulose, sugars, polyvinyl alcohol, chitosans, modified polyamines, and cellulase enzymes, but are not limited to them.

In some embodiments, the cellulose-based substrate can include a cationic starch. The cationic starch can enhance paper strength, water drainage, retention, improve paper quality; reduce dusting, linting and size addition; greater control of paper making process hence less paper web breaks and improve paper machine runnability as well as productivity. Cationic starch also allow using filler and more recycled fibers so reduce furnishes cost. As a strength additive, cationic starch improves stiffness, opacity, printing quality and brightness. Commercially available cationic starches include quaternary ammonium type cationic starch and tertiary amino type cationic starch. Quaternary ammonium type starch is cationic in all pH range, whereas tertiary amino type starch is cationic only in the acidic range.

The cationic starch strength additives can be included in the cellulose based substrate in an amount of 0.1% by weight or greater, such as 0.2% by weight or greater, 0.4% by weight or greater, 0.5% by weight or greater, 0.8% by weight or greater, 1% by weight or greater, 1.5% by weight or greater, 2% by weight or greater, 2.5% by weight or greater, 3% by weight or greater, 4% by weight or greater, or 5% by weight or greater, based on the weight of the cellulose based substrate.

In some embodiments, the cellulose-based substrate can include an anionic or cationic polyacrylamide resin. Cationic and anionic polyacrylamide strength additives are available from Hercules Incorporated of Wilmington, Del. The addition of the polymer adds a charge to the cellulose fibrous slurry and aids in the creation of a complex, which imparts both durability and strength to the finished cellulose fibrous sheet.

The polyacrylamide strength additives can be included in the cellulose based substrate in an amount of 0.1% by weight or greater, such as 0.2% by weight or greater, 0.4% by weight or greater, 0.5% by weight or greater, 0.8% by weight or greater, 1% by weight or greater, 1.5% by weight or greater, 2% by weight or greater, 2.5% by weight or greater, 3% by weight or greater, 4% by weight or greater, or 5% by weight or greater, based on the weight of the cellulose based substrate.

Other additives, such as processing agents, may also be present in the cellulose-based substrate, including, but not limited to, thickeners, dispersants, emulsifiers, viscosity modifiers, humectants, pH modifiers, among others.

Barrier Coating

In some embodiments, the printable paper can further include a barrier coating on the first surface of the cellulose-based substrate. It is current practice, for example, to add a film of polyethylene (PE), polypropylene (PP), polyester, wax, or polyvinylidene chloride (PVDC) on paper substrates to provide a moisture barrier. However, conventional barrier coatings are predominantly non-repulpable, mainly because they introduce quality problems in the fiber recovery process, either by upsetting the process, e.g., by plugging filter screens, or by contaminating the finished product. For environmental and cost reasons, the disposal of moisture barrier packaging materials has become an important issue for paper mills and their customers. Repulping these materials poses special problems for the industry. The moisture barrier layer manifests problems in recovering the useful fiber from the package. Presently, nearly all of these packages are ultimately discarded into landfills or incinerated, which raises issues with respect to the environment and public health. Reprocessing packaging to recover wood fibers is an important source of wood fibers and helps avoid waste of high quality and costly fibers.

The cellulose-based substrate can include a barrier coating that can provide a high barrier performance, printability, high performance adhesion, strength, repulpability, and low cost of manufacture. The term "barrier" is used to describe the ability of the coating to stop or retard the passage of atmospheric gases, filled gases, water vapor, volatile flavor and/or aroma ingredients, or a combination thereof.

Preferably, the barrier coatings described herein are water resistant. Water-resistance of the barrier coatings can be tested with the Cobb method, described by TAPPI T 441, which is incorporated by reference herein in its entirety. This method determines the amount of water absorbed by paper in a specified time under standardized conditions and, in some embodiments, the coated substrates described herein would pass the water-resistance test set forth in this test method. The barrier coatings that provide a barrier to water and moisture must also have the ability to form a seal and not block during the manufacturing process. For example, paper of shipping mailers must be able to be sealed when the sides of the paper are joined and the seal itself must also be resistant to liquid or moisture vapor and maintain its integrity in their presence.

The barrier coatings are desirably printable. Printability is a key attribute for packages targeting the retail or point-of-sale industries. Printability is the ability of a material to yield printed matter of good quality. Printability is judged by the print quality and uniformity of ink transfer, rate of ink wetting and drying, ink receptivity, compressibility, smoothness, opacity, color, resistance to picking, and similar factors. It is generally preferred if a material can be printed on a variety of equipment, maximizing quality of print and minimizing cost of manufacture. Printing techniques include flexographic, rotogravure, heat-set, heat transfer, offset, offset lithography, non-contact laser, inkjet, ultra-violet, hot stamp, screen, silk-screen. Overall, the printable barrier coatings preferably provide a barrier for moisture, oxygen, oils, and fatty acids, as well as mechanical performance, aesthetics, cosmetics, resistance to chemicals, recyclability, surface energy, ink adhesion, ink wet-ability, film adhesion to fibers, and improved surface for glue and adhesive application.

The printable barrier coatings described herein can be derived from an aqueous-based polymer and are present on at least one surface of the cellulose-based substrate. The aqueous-based polymer coating can comprise an aqueous-based polymer that is water-soluble and/or water-dispersible. In some embodiments, the aqueous-based polymer can comprise an acrylic homopolymer, an acrylic copolymer, a polyester acrylic copolymer, a vinyl acrylic copolymer, a wax emulsion, or a combination thereof. In some examples, the aqueous-based polymer coating can be derived from a post-consumer waste, such as recycled PET containers. Specific examples of aqueous-based polymer coatings include acrylic copolymers commercially available from Michelman (for example, MC40EAF), acrylic polymers commercially available from BASF (for example, Acronal NX4612X), polyester acrylate copolymers commercially available from Ulterion International (for example, Ulterion 560 Flex, a polyester acrylate copolymer derived from recycled PET containers).

The printable barrier coating can include the aqueous-based polymer in an amount of at least 60% by weight of the printable barrier coating (e.g., at least 65% by weight, at least 70% by weight, at least 75% by weight, at least 80% by weight, at least 85% by weight, at least 90% by weight, at least 95% by weight, at least 97% by weight, at least 99% by weight, or up to 100% by weight).

The barrier coating can, in some embodiments, further include one or more additives. The one or more additives, in some embodiments, can include inorganic particles (also referred to herein as pigments or mineral pigments). In some embodiments, the inorganic particles can be added to impart certain properties to a paper such as smoothness, whiteness, increased density or weight, decreased porosity, increased opacity, flatness, glossiness, adsorption of water (low surface tension or contact angle) or repulsion of water (high surface tension or contact angle), and the like. The inorganic particles can undergo a treatment process that will facilitate the desired property. For example, the pigments can be surface treated with materials that may include, but are not limited to surfactants, hydrophobically or hydrophilically modified polymers such as polyethyleneimine (PEI), acrylic emulsion chemistries, silanes or siloxanes, or combinations thereof.

The inorganic particles can include a metal-oxide microparticle or nanoparticle such as, aluminum oxide ($Al_2O_3$), aluminum dioxide ($AlO_2$), zinc oxide (ZnO), calcium carbonate, kaolin, clay, talc, diatomaceous earth, mica, barium sulfate, magnesium carbonate, vermiculite, graphite, carbon black, alumina, silicas, colloidal silica, silica gel, titanium oxides, aluminum hydroxide, aluminum trihydrate, satine white, magnesium oxide, or combinations thereof. In some embodiments, the inorganic particles include a silica ($SiO_2$). Without wishing to be bound by theory, it is believed that the inorganic microparticles add affinity for the inks of the printed image to the printable barrier coating. For example, it is believed that the metal-oxide porous microparticles (e.g., $SiO_2$) can absorb the ink liquid (e.g., water and/or other solvents) quickly and can retain the ink molecules upon drying, even after exposure to an organic solvent. Additionally, it is believed that metal-oxide microparticles (e.g., $SiO_2$) can add an available bonding site at the oxide that can bond (covalent bonds or ionic bonds) and/or interact (e.g., van der Waals forces, hydrogen bonding, etc.) with the ink binder and/or pigment molecules in the ink. This bonding and/or interaction between molecules of the ink composition and the oxide of the microparticles can improve the durability of the ink printed on the printable surface.

The inorganic particles can have an average diameter on the micrometer (micron or μm) scale, such as from about 1 μm to about 20 μm. Such microparticles can provide a sufficiently large surface area to interact with the ink composition applied to the printable coating, while remaining sufficiently smooth on the exposed surface. Additionally, microparticles that are too large can lead to grainy images formed on the printable coating and/or reduce the sharpness of any image applied thereto. In one particular embodiment, the printable coating can include a first plurality of inorganic microparticles having a first average diameter and a second plurality of inorganic microparticles having a second average diameter, with the first average diameter being smaller than the second average diameter. For example, the first average diameter can be about 1 μm to about 10 μm (e.g., about 4 to about 6), and the second average diameter can be about 8 μm to about 20 μm (e.g., about 8 to about 10, such as about 8 to about 9).

The printable barrier coating can include the inorganic particles in an amount of less than 40% by weight of the printable barrier coating (e.g., less than 35% by weight, less than 30% by weight, less than 25% by weight, less than 20% by weight, less than 15% by weight, less than 12% by weight, less than 10% by weight, less than 8% by weight, less than 5% by weight, less than 3% by weight, or less than 2% by weight).

The printable barrier coating, in some embodiments, can include additives such as thickeners, dispersants, emulsifiers, viscosity modifiers, humectants, pH modifiers, initiators, stabilizers, chain transfer agents, buffering agents, salts, preservatives, fire retardants, wetting agents, protective colloids, biocides, corrosion inhibitors, crosslinkers, crosslinking promoters, and lubricants. The printable barrier coating, in some embodiments, can include one or more dyes and/or colored pigments to produce a colored or patterned paper or to change the shade of the paper. Exemplary dyes can include basic dyes, acid dyes, anionic direct dyes, and cationic direct dyes. Exemplary colored pigments include organic pigments and inorganic pigments in the form of anionic pigment dispersions and cationic pigment dispersions. The additives can be included in any amount, such as up to about 5% by weight, such as about 0.1% to about 1% by weight.

As stated, a crosslinking agent can be present in the printable barrier coating to ensure that a highly crosslinked coating is formed. In particular, the aqueous-based polymer can react with the crosslinking agent to form a 3-dimensional crosslinked material. Particularly suitable crosslinking polymeric binders include those that contain reactive carboxyl groups. Exemplary crosslinking binders that include carboxyl groups include acrylics, polyurethanes, ethylene-acrylic acid copolymers, and so forth. Other desirable crosslinking binders include those that contain reactive hydroxyl groups. Cross-linking agents that can be used to crosslink binders having carboxyl groups include polyfunctional aziridines, epoxy resins, carbodiimide, oxazoline functional polymers, and so forth. Cross-linking agents that can be used to crosslink binders having hydroxyl groups include melamine-formaldehyde, urea formaldehyde, amine-epichlorohydrin, multi-functional isocyanates, and so forth.

A crosslinking catalyst can also be present in the printable barrier coating to help ensure sufficient crosslinking occurs during curing. For example, the crosslinking catalyst can be an imidazole curing agent. However, in certain embodiments, the coating can be free from such a crosslinking catalyst.

When the printable barrier coating is directed to applications for receiving a dye-based ink via ink-jet printing, the printable coating can further include a cationic polyelectrolyte, to serve as a cationic dye fixative. When present, the printable coating can include about 0.1% by weight to about 5% by weight of the cationic dye fixative.

The printable barrier coating can have, in some embodiments, a coating weight of 2 $g/m^2$ or greater (e.g., 3 $g/m^2$ or greater, 4 $g/m^2$ or greater, 5 $g/m^2$ or greater, 6 $g/m^2$ or greater, 7 $g/m^2$ or greater, 8 $g/m^2$ or greater, 9 $g/m^2$ or greater, 10 $g/m^2$ or greater, 11 $g/m^2$ or greater, 12 $g/m^2$ or greater, 13 $g/m^2$ or greater, 14 $g/m^2$ or greater, 15 $g/m^2$ or greater, 16 $g/m^2$ or greater, 17 $g/m^2$ or greater, 18 $g/m^2$ or greater, 19 $g/m^2$ or greater, 20 $g/m^2$ or greater, or 25 $g/m^2$ or greater). The printable barrier coating can have, in some embodiments, a coating weight of 25 $g/m^2$ or less (e.g., 24 $g/m^2$ or less, 23 $g/m^2$ or less, 22 $g/m^2$ or less, 21 $g/m^2$ or less, 20 $g/m^2$ or less, 19 $g/m^2$ or less, 18 $g/m^2$ or less, 17 $g/m^2$ or less, 16 $g/m^2$ or less, 15 $g/m^2$ or less, 14 $g/m^2$ or less, 13 $g/m^2$ or less, 12 $g/m^2$ or less, 11 $g/m^2$ or less, 10 $g/m^2$ or less, 9 $g/m^2$ or less, 8 $g/m^2$ or less, 7 $g/m^2$ or less, 6 $g/m^2$ or less, 5 $g/m^2$ or less, 4 $g/m^2$ or less, or 3 $g/m^2$ or less). The printable barrier coating can have, in some embodiments, a coating weight of from 2 $g/m^2$ to 20 $g/m^2$ (e.g., 5 $g/m^2$ to 20 $g/m^2$, from 2 $g/m^2$ to 15 $g/m^2$, or from 5 $g/m^2$ to 12 $g/m^2$). The coating weight can be reported in units of grams of coating per square meter of cellulose-based substrate and can be calculated directly by the amount of coating applied and the surface area of the cellulose-based substrate that the coating is applied to.

The printable barrier coating can have a thickness of from 0.5 mils or greater (e.g., 0.6 mils or greater, 0.7 mils or greater, 0.8 mils or greater, 0.9 mils or greater, 1 mil or greater, 1.1 or greater, 1.2 or greater, 1.3 or greater, 1.4 or greater, 1.5 or greater, 1.6 or greater, 1.7 or greater, 1.8 or greater, 1.9 or greater). In some embodiments, the printable barrier coating has a thickness of 2 mils or less (e.g., 1.9 or less, 1.8 or less, 1.7 or less, 1.6 or less, 1.5 or less, 1.4 or less, 1.3 or less, 1.2 or less, 1 or less, 0.9 or less, 0.8 or less, 0.7 or less, or 0.6 or less). In some embodiments, the printable barrier coating has a thickness of from 0.5 mils to 2 mils (e.g., from 0.9 mils to 1.6 mils, from 1.1 mils to 1.4 mils).

The coating thickness can be calculated based on the density of the coating and the weight of the coated paper.

Surface Treatment

Frequently, barrier coatings have favorable structural and other characteristics, however, because of surface characteristics, do not possess sufficient printability or adhesion properties. A treatment to alter the surface of the paper and other materials to make them more receptive to adhesives or printing inks may be necessary. In some embodiments, the barrier coating can be oxidized, smoothed, or combinations thereof, to improve adhesion. In some embodiments, the surface treatment can include a high energy discharge, for example an ionizing discharge and/or a thermal discharge. A "high energy discharge" as used herein refers to an energy source capable of altering the molecular bonds and/or energy on the surface of a material. In some embodiments, the energy source can break the molecular bonds on the surface of a material. The broken bonds are now free to attach to free radicals and other particles that exist in the high energy discharge environment. In some examples, the barrier coating can be surface treated (e.g., can have a physical surface treatment or a thermal treatment) using a process selected from corona treatment, plasma discharge treatment, flame treatment, or combinations thereof. Surface treating the aqueous-based polymer coatings can improve the heat seal and/or surface adhesion, for instance, between cellulose-based substrate layers.

Corona treatment includes a process of electrical discharges that create ozone, which in turn oxidizes the substrate surface and creates polar sites that contribute to strong bond formation. The treatment level is measured in dynes. A dyne in the (now deprecated) cgs system of units, is the force required to accelerate a mass of 1 gram by 1 centimeter per second squared. (1 dyne=$1\times10^5$ Newton). Thus, in packaging, it is used as a measure of surface energy or polarity of a surface. The dyne level is an indicator of the ability to wet out the surface with a liquid, forming a chemical bond with an adhesive, coating, or ink. The dyne level of a surface typically needs to be 37 or higher, depending on the nature of the adhesive substance. (ASTM D 2578). In some embodiments, the barrier coatings are corona treated at a suitable power. The barrier coatings can be corona treated at a power level of 1 watt or greater. In some embodiments, the barrier coatings are corona treated at a power level of 1 to 4 watts per square foot per minute (e.g., 2 watts or greater, 2.5 watts or greater, 3 watts or greater, or 3.5 watts or greater). In some embodiments, the barrier coatings are corona treated at 4 watts or less (e.g., 3.5 watts or less, 3 watts or less, 2.5 watts or less, or 2 watts or less). In some embodiments, the barrier coatings are corona treated at 2-4 watts per square foot per minute. The exposure time of the barrier coating on the cellulose substrate to the corona treatment can be very low. For example, the exposure time can be less than 1 second. In some embodiments, the corona treatment can be conducted on a moving paper substrate web run on a coating line. In some embodiments, the barrier coatings can be corona treated on a coating line using a line speed of 100 ft/min or greater. For example, the barrier coatings can be corona treated using a line speed of 500 ft/min to 5000 ft/min, such as 500 ft/min to 1000 ft/min.

An increase in surface energy can increase the wettability and adhesion characteristics of the surface. Once the watt density is known to get the aqueous-based polymer coating to a certain dyne level, it can be used to predict the results, if any, of parameters changes such as line speed.

Back Coating

In some aspects, the cellulose based substrates have high dimensional stability, with a diminished tendency to curling. In some embodiments, a film forming polymer can be coated on the backside (surface opposite the barrier coated side) of the cellulose-based substrate. Preferably, the film forming polymer is bio-based, wherein at least 80% of the polymer film by weight is derived from a non-petroleum or biorenewable feedstock.

Examples of film forming polymer that can reduce curl include polyvinyl alcohol (PVOH), polyvinylamine, alginate, a polyester elastomer, a natural-based polymer (e.g., starch, gum, cellulose, carboxymethyl cellulose), etc.

The back coating can have, in some embodiments, a coating weight of 0.2 g/m$^2$ or greater (e.g., 0.3 g/m$^2$ or greater, 0.4 g/m$^2$ or greater, 0.5 g/m$^2$ or greater, 0.6 g/m$^2$ or greater, 0.7 g/m$^2$ or greater, 0.8 g/m$^2$ or greater, 0.9 g/m$^2$ or greater, 1.0 g/m$^2$ or greater, 1.1 g/m$^2$ or greater, 1.2 g/m$^2$ or greater, 1.3 g/m$^2$ or greater, 1.4 g/m$^2$ or greater, 1.5 g/m$^2$ or greater, 1.6 g/m$^2$ or greater, 1.7 g/m$^2$ or greater, 1.8 g/m$^2$ or greater, 1.9 g/m$^2$ or greater, 2.0 g/m$^2$ or greater, 2.1 g/m$^2$ or greater, 2.2 g/m$^2$ or greater, 2.3 g/m$^2$ or greater, 2.4 g/m$^2$ or greater, 2.5 g/m$^2$ or greater, 2.6 g/m$^2$ or greater, 2.7 g/m$^2$ or greater, 2.8 g/m$^2$ or greater, or 2.9 g/m$^2$ or greater). The back coating can have, in some embodiments, a coating weight of 5.0 g/m$^2$ or less (e.g., 3.0 g/m$^2$ or less, 2.8 g/m$^2$ or less, 2.7 g/m$^2$ or less, 2.6 g/m$^2$ or less, 2.5 g/m$^2$ or less, 2.4 g/m$^2$ or less, 2.3 g/m$^2$ or less, 2.2 g/m$^2$ or less, 2.1 g/m$^2$ or less, 2.0 g/m$^2$ or less, 1.9 g/m$^2$ or less, 1.8 g/m$^2$ or less, 1.7 g/m$^2$ or less, 1.6 g/m$^2$ or less, 1.5 g/m$^2$ or less, 1.4 g/m$^2$ or less, 1.3 g/m$^2$ or less, 1.2 g/m$^2$ or less, 1.1 g/m$^2$ or less, 1.0 g/m$^2$ or less, 0.9 g/m$^2$ or less, 0.8 g/m$^2$ or less, 0.7 g/m$^2$ or less, 0.6 g/m$^2$ or less, 0.5 g/m$^2$ or less, 0.4 g/m$^2$ or less, or 0.3 g/m$^2$ or less). The back coating can have, in some embodiments, a coating weight of from 0.2 g/m$^2$ to 3.0 g/m$^2$ (e.g., 0.5 g/m$^2$ to 2.8 g/m$^2$, or from 1.0 g/m$^2$ to 2.5 g/m$^2$).

Printable Papers, Shipping Mailers, and Packaging Containers

As described herein, the printable paper of the disclosure is repulpable. The process of repulping refers to any mechanical action that disperses dry, pulp fibers into an aqueous pulp fiber suspension. Conditions for repulping, as well as equipment commercially used, are in accordance with the Fiberboard Association Voluntary Standard for Repulping and Recycling Corrugated Fiberboard Treated to Improve its Performance in the Presence of Water and Water Vapor Aug. 16, 2013: Appendix A: Repulpability, which reference is incorporated herein by reference in its entirety.

In some embodiments, the printable paper can be repulpable in accordance with the Fiberboard Association Voluntary Standard for Repulping and Recycling Corrugated Fiberboard Treated to Improve its Performance in the Presence of Water and Water Vapor Aug. 16, 2013: Appendix A: Repulpability With the added components described herein, the printable paper can be produced with strength properties well suited for commercial mailer applications having a basis weight of 120 lbs/3000 ft$^2$ or less. For example, the printable paper can have a basis weight of 118 lbs/3000 ft$^2$ or less (e.g., 115 lbs/3000 ft$^2$ or less, 110 lbs/3000 ft$^2$ or less, 105 lbs/3000 ft$^2$ or less, 100 lbs/3000 ft$^2$ or less, 95 lbs/3000 ft$^2$ or less, 90 lbs/3000 ft$^2$ or less, 85 lbs/3000 ft$^2$ or less, 80 lbs/3000 ft$^2$ or less, 75 lbs/3000 ft$^2$ or less, 70 lbs/3000 ft$^2$ or less, 65 lbs/3000 ft$^2$ or less, 60 lbs/3000 ft$^2$ or less, 55 lbs/3000 ft$^2$ or less, or 50 lbs/3000 ft$^2$ or less). In some embodiments, the printable paper has a basis weight of 45 lbs/3000 ft$^2$ or greater (e.g., 50 lbs/3000 ft$^2$ or greater, 55 lbs/3000 ft$^2$ or greater, 60 lbs/3000 ft$^2$ or greater, 65 lbs/3000

$ft^2$ or greater, 70 lbs/3000 $ft^2$ or greater, 75 lbs/3000 $ft^2$ or greater, 80 lbs/3000 $ft^2$ or greater, 85 lbs/3000 $ft^2$ or greater, 90 lbs/3000 $ft^2$ or greater, 95 lbs/3000 $ft^2$ or greater, 100 lbs/3000 $ft^2$ or greater, 105 lbs/3000 $ft^2$ or greater, 110 lbs/3000 $ft^2$ lbs/3000 $ft^2$ or greater, 115 lbs/3000 $ft^2$ or greater, or 120 lbs/3000 $ft^2$ or greater). In some embodiments, the printable paper has a basis weight from 50 lbs/3000 $ft^2$ to 120 lbs/3000 $ft^2$ (e.g., from 60 lbs/3000 $ft^2$ to 120 lbs/3000 $ft^2$, from 70 lbs/3000 $ft^2$ to 110 lbs/3000 $ft^2$, from 70 lbs/3000 $ft^2$ to 100 lbs/3000 $ft^2$, or from 75 lbs/3000 $ft^2$ to 100 lbs/3000 $ft^2$.

The printable paper can exhibit a 2-minute Cobb Sizing value of less than 20 $g/m^2$, as determined by and TAPPI T 441. For example, the printable paper can exhibit a 2-minute Cobb Sizing value of 20 $g/m^2$ or less (e.g., 19 $g/m^2$ or less, 18 $g/m^2$ or less, 17 $g/m^2$ or less, 16 $g/m^2$ or less, 15 $g/m^2$ or less, 14 $g/m^2$ or less, 13 $g/m^2$ or less, 12 $g/m^2$ or less, 11 $g/m^2$ or less, 10 $g/m^2$ or less, 9 $g/m^2$ or less, 8 $g/m^2$ or less, 7 $g/m^2$ or less, 6 $g/m^2$ or less, 5 $g/m^2$ or less, 4 $g/m^2$ or less, or 3 $g/m^2$ or less). The printable paper can exhibit a 2-minute Cobb Sizing value of less than 20 $g/m^2$, as determined by and TAPPI T 441 from 0.2 $g/m^2$ to 20 $g/m^2$ (e.g., 0.2 $g/m^2$ to 18 $g/m^2$, from 0.2 $g/m^2$ to 15 $g/m^2$, or from 2 $g/m^2$ to 10 $g/m^2$).

The printable paper can exhibit a tensile strength (MD) of at least 45 lbf/in (e.g., at least 45 lbf/in, at least 55 lbf/in, or at least 65 lbf/in) or at least 70 lbf/in (e.g., at least 70 lbf/in, at least 80 lbf/in, at least 90 lbf/in, at least 100 lbf/in, at least 110 lbf/in, at least 120 lbf/in, at least 130 lbf/in, at least 140 lbf/in, at least 150 lbf/in, at least 160 lbf/in, at least 170 lbf/in, at least 180 lbf/in, at least 190 lbf/in, or at least 200 lbf/in), as determined by TAPPI T 494.

The printable paper can exhibit a tensile strength (CD) of at least 30 lbf/in (e.g., at least 30 lbf/in, at least 40 lbf/in, at least 50 lbf/in, at least 60 lbf/in, at least 70 lbf/in, at least 80 lbf/in, at least 90 lbf/in, at least 100 lbf/in, at least 110 lbf/in, or at least 120 lbf/in), as determined by TAPPI T 494.

The printable paper can exhibit a tensile energy absorption (MD) of at least 200 $J/m^2$ (e.g., at least 210 $J/m^2$, at least 215 $J/m^2$, at least 220 $J/m^2$, at least 230 $J/m^2$, at least 240 $J/m^2$, at least 250 $J/m^2$, at least 260 $J/m^2$, at least 270 $J/m^2$, at least 280 $J/m^2$, at least 290 $J/m^2$, or at least 300 $J/m^2$), as determined by TAPPI T 494.

The printable paper can exhibit a tensile energy absorption (CD) of at least 340 $J/m^2$ (e.g., at least 345 $J/m^2$, at least 350 $J/m^2$, at least 355 $J/m^2$, at least 360 $J/m^2$, at least 365 $J/m^2$, at least 370 $J/m^2$, at least 375 $J/m^2$, at least 380 $J/m^2$, at least 385 $J/m^2$, at least 390 $J/m^2$, at least 395 $J/m^2$, at least 400 $J/m^2$, or at least 405 $J/m^2$), as determined by TAPPI T 494.

The printable paper can exhibit a tear resistance (MD) of at least 170 gf (e.g., at least 175 gf, at least 180 gf, at least 190 gf, at least 200 gf, at least 210 gf, at least 215 gf, at least 220 gf, at least 230 gf, at least 235 gf, at least 240 gf, at least 250 gf,), as determined by TAPPI T 414.

The printable paper can exhibit a tear resistance (CD) of at least 180 gf (e.g., at least 185 gf, at least 190 gf, at least 195 gf, at least 200 gf, at least 205 gf, at least 210 gf, at least 215 gf, at least 220 gf, at least 225 gf, at least 230 gf, at least 235 gf,), as determined by TAPPI T 414.

The printable paper can exhibit a tensile index (MD) as defined by dividing the tensile strength in N/m by the basis weight in $g/m^2$ from 70 to 95 Nm/g (e.g., from 75 Nm/g to 90 Nm/g, 80 Nm/g to 88 Nm/g, or 82 Nm/g to 86 Nm/g).

The printable paper can exhibit a tensile index (CD) as defined by dividing the tensile strength in N/m by the basis weight in $g/m^2$ from 40 to 60 Nm/g (e.g., from 45 Nm/g to 55 Nm/g, or from 47 Nm/g to 51 Nm/g).

The first surface, second surface, or both of the printable paper can exhibit a surface energy from 37 dynes/cm to greater than 60 dynes/cm (e.g., greater than 37 dynes/cm, greater than 40 dynes/cm, greater than 45 dynes/cm, greater than 50 dynes/cm or greater than 55 dynes/cm; or from 37 dynes/cm to 45 dynes/com, or from 40 dynes/cm to 45 dynes/cm).

The printable paper can be used for making a shipping mailer. In some embodiments, the shipping mailer can be derived from a printable paper as disclosed herein. In some embodiments, the entire shipping mailer can be derived from the printable paper. In further embodiments, the shipping mailer can be an envelope.

The printable paper can be used for making a recyclable flexible packaging container, wherein at least a portion or the entire packaging container is derived from the printable paper. The recyclable flexible packaging container can be a shipping mailer such as an envelope. For example, provided herein are recyclable flexible packaging container, comprising an interior surface defining a product volume, wherein the interior surface is derived from a cellulose-based substrate as described herein, an exterior surface opposite the interior surface having a surface energy of greater than 37 dynes/cm.

The recyclable flexible packaging containers are preferably recyclable in a single stream, such as in curbside recycling. For example, the recyclable flexible packaging containers are repulpable in accordance with the Fiberboard Association Voluntary Standard for Repulping and Recycling Corrugated Fiberboard Treated to Improve its Performance in the Presence of Water and Water Vapor Aug. 16, 2013: Appendix A: Repulpability.

These and other modifications and variations to the present invention may be practiced by those of ordinary skill in the art, without departing from the spirit and scope of the present invention, which is more particularly set forth in the appended claims. In addition, it should be understood the aspects of the various embodiments may be interchanged both in whole or in part. Furthermore, those of ordinary skill in the art will appreciate that the foregoing description is by way of example only and is not intended to limit the invention so further described in the appended claims.

EXAMPLES

Example 1: Mailer

Conventional fiber-based mailers do not provide protection from water penetration resulting in compromised durability and greater potential for product damage. Furthermore, these products are generally produced from poor quality fiber resulting in an inferior strength/basis weight relationship. Durability is therefore achieved at the cost of increased mailer weight, a key consideration for many brands. The present example provides materials for packaging containers that can meet the rigors of commercial shipping (such as of apparels) while providing a sustainable alternative to plastic based materials and novel performance advantages at a competitive basis weight, over currently available fiber-based products.

Premium Mailer Base Stock

Several coated mailer base stocks can be produced according to Table 1 or were produced according to the parameters defined in Tables 2-5. The base stocks were produced in accordance with standard papermaking procedures with a fiber furnish comprising 50% post-consumer waste (PCW) and 50% Northern Bleached Softwood kraft (NBSK) composed predominately (>75%) of black spruce fiber. A combination of cationic starch and anionic polyacrylamide dry strength resin (Hercobond 2000) were added at the wet end of the paper machine. Calendering was not required.

Following the base paper production, functional coatings were applied to one or both sides of the base paper. The top coat (wire side) was a barrier coating with a coat weight ranging from 5.0-12.0 gsm. A 2% PVOH backside (felt side) coating was applied to provide a flat, curl-free web using an air knife pressure of approximately 3 psi. Standard coating application and drying conditions were maintained to achieve optimal barrier properties.

TABLE 1

Exemplary coated mailer base stocks.

| Sample | Basis Weight of Base Stock (lbs./ 1,300 ft$^2$) | Front (wire) side coating | Coat weight of wire coating (oz/sy) | Back (felt) side coating |
|---|---|---|---|---|
| 1 | 42 | 20% Ulterion 560 Flex | 0.30 oz/sy | 2% PVOH (minimum) |
| 2 | 42 | | 0.30 oz/sy | water (minimum) |
| 3 | 42 | | 0.30 oz/sy | water (minimum) |
| 4 | 38 | 20% Ulterion 560 Flex | 0.15 | |
| 5 | 34 | | 0.15 | |
| 6 | 30 | | 0.15 | |
| 7 | 42 | | 0.15 | |
| 8 | 42 | | 0.07 | |
| 9 | 42 | Michelman MC40EAF | 0.15 | |
| 10 | 38 | | 0.15 | |
| 11 | 38 | 10% Acronal NX4612X | 0.15 | |
| 12 | 42 | | 0.15 | |
| 13 | 42 | | 0.07 | |

Table 2 shows Trial 1 results from base stock production.

TABLE 2

Results from base stock production of base paper.

| Characteristics | Std. Method | Units | Trial Results 1 |
|---|---|---|---|
| Basis Weight | T 410 | lbs./ 1300 ft$^2$ | 41.5 |
| Smoothness-Sheffield | T-538 | SU | 220 |
| Smoothness Deviation | T-538 | SU | 24 |
| Caliper | T 411 | mils | 7.06 |
| Caliper Deviation | T 411 | mils | 0.10 |
| Moisture | T 412 | % | 5 |
| Dirt | T 537 | ppm | 13 |
| Curl-Visual | NP | FxP | W2P |
| Wax Pick | T 459 | Wax # | 17 |
| Sizing-Hercules | T 530 | sec. | 1378 |
| Porosity-Sheffield | T 547 | um/Pa * sec. | 14 |
| ZDT | T 541 | psi | 171 |
| Tear-Elmendorf MD | T 415 | gf | 139 |
| Tear-Elmendorf CD | T 416 | gf | 160 |
| TEA-MD | T494 | J/m2 | 260 |
| TEA-CD | T494 | J/m2 | 317 |
| Tensile Strength MD Dry | T 495 | lbf/in. | 86 |
| Tensile Strength CD Dry | T 496 | lbf/in. | 43 |
| Stretch-MD | T 494 | % | 2.52 |
| Stretch-CD | T 494 | % | 5.74 |
| Color-DL | ISO 5631-1: 2015 | CIE | −0.37 |
| Color Da | ISO 5631-1: 2015 | CIE | −0.4 |
| Color-Db | ISO 5631-1: 2015 | CIE | 0.22 |
| Color-DE | ISO 5631-1: 2015 | CIE | 0.59 |
| Sizing-Cobb-2 min. | T-441 | gsm | |
| Fold MD-MIT | T 511 | cycles | |
| Fold CD-MIT | T 511 | cycles | |
| Stiffness-Taber | T-489 | gf * cm | |
| Stiffness-Taber | T-489 | gf * cm | |

Table 3 shows Trials 1-5 results from coated base stocks.

TABLE 3

Results from coated base stock production.

| Coating | Coat Weight—Face | Coat Weight—Face | Coat Weight—Back | Coat Weight—Back | Caliper | Moisture | Smoothness-Sheffield | Curl-Dynamic |
|---|---|---|---|---|---|---|---|---|
| Std. Method | QT-QMS | Calc. | QT-QMS | Calc. | T 411 | T 412 | T-538 | DTM-0020 |
| Units | oz./yd$^2$ | gsm | oz./yd$^2$ | gsm | mils | % | SU | in. |
| Ulterion 560 Flex (Trial 1) | 0.37 | 12.5 | 0.0 | 0 | 7.6 | 4.4 | 102 | 1.2 |
| Ulterion 560 Flex (Trial 2) | 0.15 | 5.1 | 0.0 | 0 | 7.3 | 4.1 | 156 | 1.2 |
| Acronal NX4612X (Trial 3) | 0.18 | 6.1 | 0.0 | 0 | 7.2 | 3.9 | 117 | 1.2 |
| Ulterion 560 Flex/ PVOH (Trial 4) | 0.175 | 5.9 | 0.015 | 0.5 | 7.7 | 4.2 | 125 | 0.12 |
| Ulterion 560 Flex/ Water (Trial 5) | 0.18 | 6.1 | 0.00 | 0.0 | 7.7 | 4.3 | 132 | 1.5 |

Table 4 shows characteristics of Trials 1~4 results from coated base stocks.

TABLE 4

Characteristics of coated base stock production.

| Attributes | Characteristics | Std. Method | Units | Trial Results 1 | Trial Results 2 | Trial Results 3 | Trial Results 4 |
|---|---|---|---|---|---|---|---|
| Durability | Burst | T 403 | psi | | | | |
| | Burst—Wet | R&D | psi | | | | |
| | Burst—Wet | R&D | Ratio | | | | |
| | Fold CD—MIT | T 511 | cycles | | | | |
| | Fold CD—MIT | T 511 | cycles | | | | |
| | Tensile Strength MD Dry | T 495 | lbf/in. | 79.8 | 83.65 | 74.3 | 81.9 |
| | Tensile Strength CD Dry | T 496 | lbf/in. | 38.6 | 39.4 | 41.6 | 38.9 |
| | Stretch—MD | T 494 | % | 2.6 | 2.8 | 2.6 | 2.9 |
| | Stretch—CD | T 494 | % | 5.5 | 6 | 6.3 | 5.5 |
| | TEA—MD | T494 | $J/m^2$ | 221 | 247 | 194 | 241 |
| | TEA—CD | T494 | $J/m^2$ | 268 | 310 | 334 | 310 |
| | Tear—Elmendorf MD | T 415 | Gf | 156 | 175 | 170 | |
| | Tear—Elmendorf CD | T 416 | Gf | 172 | 211 | 171 | |
| Water Repellency | Sizing—Cobb—2 min. | T-441 | Gsm | 3 | 7 | 10 | 3.5 |
| | Sizing—Cobb—2 hour | T-441 | Gsm | | | | |
| | Sizing—Cobb—4 hour | T-441 | Gsm | | | | |
| Printability | Surface Energy—Dyne pen | R&D | dynes/cm | 34 | 34 | 34 | 34 |
| | Surface Energy—Corona Treated | R&D | dynes/cm | | | 39 | |
| | Smoothness—Sheffield | T-538 | SU | 102 | 156 | 117 | 125 |
| | Sutherland Rub Resistance | 0 | Cycles | | | | |
| Gluability/Sealability | Glue-ability—Liquor | DTM-0030 | Pass/Fail | | | | |
| | Glue-ability—Cold Liquid Glue | Papercone | Pass/Fail | Marginal | Marginal | Marginal | |
| | Glue-ability—Hot Melt | Papercone | Pass/Fail | Pass | Pass | Pass | |
| | PSA Adhesion—Closure | Papercone | Pass/Fail | Fail-No Fiber Tear | Fail-No Fiber Tear | Fail-No Fiber Tear | |
| | PSA Label Adhesion | | Pass/Fail | | | | |
| | Heat Seal | | Pass/Fail | | | | |
| Folding Properties | Bending Force | | g/cm | | | | |
| | Folding Performance—Prod. | Papercone | Pass/Fail | Pass | Pass | Pass | |
| | Dead—Fold | | degrees | | | | |
| | Flex-crack | DTM-0014 | Cycles | Pass | Pass | Pass | Pass |
| Surface Characteristics | Blocking—High Humidity | DTM-0011 | 1-5 | 5 | 5 | 5 | 5 |
| | COF—Inclined Plane | T 548 | # | | | | |
| | Gloss-20° | T 653 | % | 4 | 2.8 | 11.2 | 3.5 |
| | Curl | DTM-0019 | in. | 1.2 | 1.52 | 1.4 | 0.12 |
| | Color—Diffuse | | % | 72.85 | 72.50 | 70.40 | 72.35 |
| | Color—Diffuse | | % | 2.45 | 2.60 | 3.00 | 2.50 |
| | Color—Diffuse | | % | 12.7 | 12.90 | 13.70 | 12.00 |
| | Color—Diffuse | | % | | | | |
| | Color—Diffuse | | % | | | | |
| | Color—Diffuse | | % | | | | |
| | Color—Diffuse | | % | | | | |

TABLE 4-continued

| Characteristics of coated base stock production. | | | | | | | |
|---|---|---|---|---|---|---|---|
| Attributes | Characteristics | Std. Method | Units | Trial Results 1 | Trial Results 2 | Trial Results 3 | Trial Results 4 |
| Environmental Attributes | Repulpability | | Pass/Fail | Pass | Pass | Pass | Pass |
| | Compostability | | Pass/ Fail | | | | |
| | Recyclable | | Pass/ Fail | | | | |

Repulpability Testing

FBA Repulpability tests were performed on four coated paper samples according to the Voluntary Standard For Repulping and Recycling Corrugated Fiberboard Treated to Improve Its Performance in the Presence of Water and Water Vapor Aug. 16, 2013: Appendix A: Repulpability. The samples were conditioned and tested in TAPPI standard conditions. The samples were prepped at 1"×4" and some shorter pieces were used to get an initial charge of 25 oven dry grams. Tap water was used for repulping and screening. Oven dry weights were used for initial charge as well as accepts and rejects. Samples were screened for 20 minutes through a 0.010" slotted valley screen. Accepts were screened using a 150 Mesh T 316 alloy stainless steel screen with opening widths of 0.0041".

The results from the repulpability tests are summarized in Table 5 below.

TABLE 5

| FBA Repulpability. | | | | |
|---|---|---|---|---|
| | Ulterion @5 gsm | Ulterion @ 12 gsm | Acronal @5 gsm | Uncoated Base |
| Initial Oven Dried Weight (g) | 25.2 | 25.2 | 25.3 | 25.5 |
| Accepts Oven Dried Weight (g) | 23.45 | 23.29 | 24.17 | 24.28 |
| Rejects Oven Dried Weight (g) | 0.00 | 0.00 | 0.01 | 0.00 |
| Percent of Rejects based on Fiber Collected (%) | 0.00 | 0.00 | 0.00 | 0.00 |
| Yield based on Total Fibers Collected (% Accepts) | 100.0 | 100.0 | 100.0 | 100.0 |
| Yield based on Total Fibers Collected Pass/Fail) | Pass | Pass | Pass | Pass |
| Operational Impact (Deposition on vessel walls, screens, moving parts) (Pass/Fail) | Pass | Pass | Pass | Pass |

Results: At 34 dynes/cm, the surface energy of the base stock was too low for the aqueous inks typically used in Papercone's flexographic printing process resulting in insufficient ink absorption, drying deficiencies and excessive set-off. The optimal range for surface energy was estimated to be 40-45 dynes/cm.

Resulting from the single side (C1S) application of the barrier coating, the coated base stock exhibited CD oriented curl. This caused the center seam on the prototype mailers to pop open. This was ultimately rectified by the compression inherent in carton packing.

The pressure sensitive adhesive used at the envelop closure did not bond securely to the coated surface of the mailer base stock. As a result, fiber tear was not achieved upon opening the mailer. This is a tamper evident feature for most customers. As with the printing difficulties, this deficiency was believed to be due to the low surface energy and can be rectified by increasing the surface energy of the coating.

The compositions and methods of the appended claims are not limited in scope by the specific compositions and methods described herein, which are intended as illustrations of a few aspects of the claims and any compositions and methods that are functionally equivalent are intended to fall within the scope of the claims. Various modifications of the compositions and methods in addition to those shown and described herein are intended to fall within the scope of the appended claims. Further, while only certain representative compositions and method steps disclosed herein are specifically described, other combinations of the compositions and method steps also are intended to fall within the scope of the appended claims, even if not specifically recited. Thus, a combination of steps, elements, components, or constituents may be explicitly mentioned herein or less, however, other combinations of steps, elements, components, and constituents are included, even though not explicitly stated. The term "comprising" and variations thereof as used herein is used synonymously with the term "including" and variations thereof and are open, non-limiting terms. Although the terms "comprising" and "including" have been used herein to describe various embodiments, the terms "consisting essentially of" and "consisting of" can be used in place of "comprising" and "including" to provide for more specific embodiments of the invention and are also disclosed. Other than in the examples, or where otherwise noted, all numbers expressing quantities of ingredients, reaction conditions, and so forth used in the specification and claims are to be understood at the very least, and not as an attempt to limit the application of the doctrine of equivalents to the scope of the claims, to be construed in light of the number of significant digits and ordinary rounding approaches.

What is claimed is:

1. A printable paper, comprising:

a cellulose-based substrate having a first surface and a second surface opposite the first surface, a printable barrier coating on the first surface of the cellulose-based substrate, the printable barrier coating derived from an aqueous-based polymer comprising an acrylic homopolymer, an acrylic copolymer, a polyester acrylic copolymer, a vinyl acrylic copolymer, a wax emulsion, or a combination thereof, wherein the printable barrier coating has been surface treated with a high energy discharge; and a backside coating on the second surface of the cellulose-based substrate that is different than the printable barrier coating comprising a film-forming polymer, wherein the printable paper has a 2-minute Cobb Sizing value of less than 20 g/m$^2$, and wherein the first surface has a surface energy of greater than 37 dynes/cm.

2. The printable paper of claim 1, exhibiting a tensile strength (MD) of at least 45 $lb_f$/in, as determined by TAPPI T 494.

3. The printable paper of claim 1, having a basis weight of from 60 lbs/3000 $ft^2$ to 120 lbs/3000 $ft^2$.

4. The printable paper of claim 1, wherein the printable paper has a 2-minute Cobb Sizing value of less than 15 $g/m^2$.

5. The printable paper of claim 1, wherein the first surface, the second surface, or both has a surface energy of from 40 dynes/cm to 45 dynes/cm.

6. The printable paper according to claim 1, wherein the printable paper exhibits a tensile energy absorption (MD) of at least 200 $J/m^2$, as determined by TAPPI T 494.

7. The printable paper according to claim 1, wherein the printable paper exhibits a tear resistance (MD) of at least 170 gf, as determined by TAPPI T 414.

8. The printable paper according to claim 1, wherein the printable barrier coating has been surface treated using corona treatment.

9. The printable paper according to claim 1, wherein the printable barrier coating has a coating weight from 2 $g/m^2$ to 20 $g/m^2$.

10. The printable paper according to claim 1, wherein the tensile index (MD) as defined by dividing the tensile strength in N/m by the basis weight in $g/m^2$ is from 70 to 95 Nm/g.

11. The printable paper according to claim 1, wherein the film-forming polymer in the backside coating comprises polyvinyl alcohol (PVOH), polyvinylamine, alginate, a polyester elastomer, a natural-based polymer, or a mixture thereof.

12. The printable paper of claim 1, exhibiting a tensile strength (MD) of at least 70 $lb_f$/in, as determined by TAPPI T 494.

13. The printable paper according to claim 1, wherein the cellulose-based substrate includes dry strength additives.

14. The printable paper according to claim 13, wherein the dry strength additives include a cationic starch and a polyacrylamide resin.

15. The printable paper according to claim 1, wherein the printable barrier coating further comprises an inorganic particle.

16. The printable paper according to claim 15, wherein the inorganic particle is surface treated.

17. The printable paper according to claim 15, wherein the inorganic particle includes silica.

* * * * *